United States Patent [19]

Kimmelaar et al.

[11] Patent Number: 4,547,997

[45] Date of Patent: Oct. 22, 1985

[54] ADJUSTABLE TOOL MOUNT

[75] Inventors: Rudolf J. A. Kimmelaar, Vlaardingen; Cornelis A. Smits, Meerkerk, both of Netherlands

[73] Assignee: Cincinnati Milacron Inc., Cincinnati, Ohio

[21] Appl. No.: 609,309

[22] Filed: May 11, 1984

[51] Int. Cl.[4] ..... B24B 41/04

[52] U.S. Cl. ..... 51/168; 83/666; 83/676; 409/234

[58] Field of Search ..... 51/168, 209 R; 409/234; 83/666, 665, 663, 676; 279/1 Q

[56] References Cited

U.S. PATENT DOCUMENTS

| | | | |
|---|---|---|---|
| 813,167 | 2/1906 | Olmsted | 51/168 |
| 1,706,206 | 3/1929 | Alwill | 51/168 |
| 1,974,553 | 9/1934 | Wilson | 51/168 |
| 3,172,326 | 3/1965 | Hamilton | 83/676 |
| 4,284,283 | 8/1981 | Stermann | 279/1 Q |

*Primary Examiner*—Roscoe V. Parker

*Attorney, Agent, or Firm*—Thomas M. Farrell

[57] ABSTRACT

An adjustable tool mount positions a rotatable tool on a machine tool spindle by a central tool mount ring having a internal thread machined throughout. The thread engages a pin extending from the tool spindle, so that rotation of the assembly causes axial advancement of the tool mount. The tool mount is clamped and unclamped by a lock nut received on the tool mount which compresses a plurality of nested conical spring rings which are closely fitted to a counterbore within the tool mount and to the machine spindle. Compression of the spring rings tends to enlarge the ring outer diameter and tends to reduce the ring bore, thereby causing a secure frictional grip to be effected between the tool mount and machine spindle.

4 Claims, 1 Drawing Figure

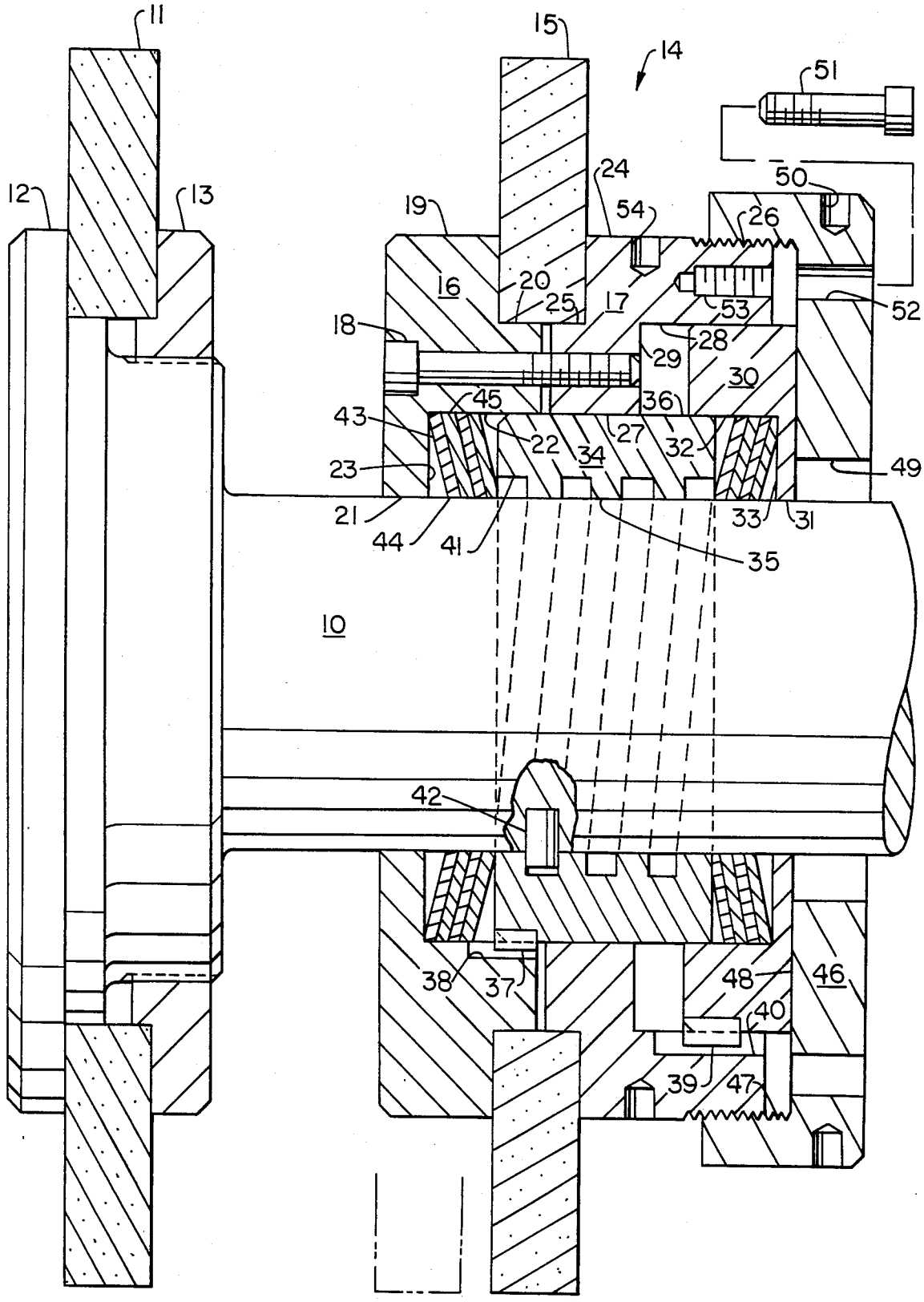
11
12
13
15
14
51
24
50
19
54
26
16
20
25
17
53
52
18
28
29
30
45
36
43
22
27
32
34
49
23
21
44
41
33
31
35
10
42
38
37
48
46
40
39
47

ADJUSTABLE TOOL MOUNT

BACKGROUND OF THE INVENTION

The invention relates generally to machines which require repositioning of a rotary tool with respect to a reference point on the machine.

More specifically, the invention relates to machine tools such as grinding and milling machines, which often employ at least two rotary tools, and where it is desirable to periodically vary the axial distance between the two tools.

On machines, such as a centerless grinder, similar parts may have the same diameters to be ground, but the ground diameters, or lands, may be of different axial dimension from one another within a given family of parts, such as hydraulic valve spools. Multiple grinding wheels are typically located on a common grinding wheel collet, received on the grinding spindle, and the collet makes use of ring-like spacers to spread the wheels. When it is necessary to vary the distance between the wheels, the collet may be replaced by an entirely different collet and wheel set up, or the collet must be dismantled to replace the spacer rings between the grinding wheels.

The aforesaid mentioned technique for varying the axial spread dimensions of grinding wheels proves to be cumbersome and costly in terms of parts required and in wheel set-up time.

Applicant has obviated the difficulties inherent in the tool usage for varying the axial spread dimension between a pair of rotary tools, such as grinding wheels, by a novel tool setup which provides for one wheel to be fully and easily adjustable with respect to the other wheel by a thread-like mechanism embodying nested conical springs to effect clamping and unclamping of the tool setup.

It is therefore an object of the present invention to provide for a tool holder which may be adjustably positioned on machine tool spindle in a quick and efficient manner.

Another object of the present invention is to provide for an adjustable rotary tool holder which embodies a spring mechanism to easily effect clamp and unclamp of the tool holder on the machine tool spindle.

SUMMARY OF THE INVENTION

The invention is shown embodied in an adjustable tool mount useful for positioning a rotatable tool on a machine spindle wherein a tool holder has a bore received in a sliding fit with a machine spindle, and an internal groove having an axial lead is provided around the bore of the tool holder. A pin is fixed in the spindle and extends radially into the internal groove of the tool holder. Means is provided for releasably clamping the tool holder in a variety of fixed positions relative to the spindle, and means is provided for rotating the tool holder relative to the spindle to accomplish adjustment of the tool holder on the spindle from a first axial position to a second axial position.

BRIEF DESCRIPTION OF THE DRAWINGS

The single drawing FIGURE represents a cross-section through an adjustable rotary tool mount located on a machine tool spindle.

DESCRIPTION OF THE PREFERRED EMBODIMENT

The drawing depicts a rotatable machine tool spindle 10 for supporting and driving a rotary tool, for example the grinding wheel 11 depicted, which is mounted on a spindle flange 12 and secured by a lock nut 13 threadably received on the spindle 10. The grinding wheel 11 serves as a reference point for axially positioning an adjustable tool mount 14 also carried by the spindle 10.

The adjustable tool mount 14 likewise carries a grinding wheel 15, and the grinding wheel 15 is secured between a back flange ring 16 and a front flange ring 17 which are fastened together in rigid assembly by a plurality of screws 18. The back flange ring 16 has a flange portion 19 and a reduced tool pilot diameter 20 adjacent the flange portion 19. A precision central bore 21 through the back flange ring 16 is received on the machine tool spindle 10. A central counterbore 22 is provided in the tool pilot diameter 20, terminating at a counterbore seat 23. The front flange ring 17 has a flange portion 24 and an adjacent reduced tool pilot diameter 25 of the same size to that of the back flange ring 16. The outer end 26 of the flange portion 24 is provided with external threads. The front flange ring 17 has a central bore 27 of equivalent diameter to the central counterbore 22 of the back flange ring 16, and a counterbore 28 is provided in the flange portion 24, terminating at a counterbore seat 29 approximately midway through the front flange ring 24.

An outer compression ring 30 is slidably received in the counterbore 28 of the front flange ring 17 and in normal assembly extends partway out of the flange ring 17. The outer compression ring 30 is cylindrical and has a central bore 31 slidably received on the machine tool spindle 10. A central counterbore 32 is machined in the compression ring 30 terminating at a counterbore seat 33. The counterbore 32 is of equal diameter to the central bore 27 of the front flange ring 17, and is disposed opening toward the back flange ring 16. A cylindrical inner compression ring 34 has a close-fitting bore 35 which is received on the machine tool spindle 10. The closefitting outer diameter 36 of the inner compression ring 34 is slidably received in the back flange ring counterbore 22, the central bore 27 of the front flange ring 17, and the counterbore 32 of the outer compression ring 30. The inner compression ring 34 has an external key 37 which is received in a keyway 38 in the back flange ring 16 to prevent relative rotation between the two. The outer compression ring 30 has an external key 39 which is received in a keyway 40 in the front flange ring 17 to prevent relative rotation between the two. An internal helical groove 41 is machined within the bore 35 of the inner compression ring 34, and a pin 42 seated in the machine tool spindle 10 projects radially into the internal groove 41. The crosssection of the pin 42 and groove 41 is relatively unimportant, so long as the two are cooperatingly forward to one another. A plurality of radially-extending holes 54 are provided around the circumference of the front flange ring 17, so that a spanner wrench (not shown) may be employed to rotate the adjustable tool mount 14. It can thus be seen that rotation of the front flange ring 17 will cause the back flange ring 16 and inner and outer compression rings 34,30 to rotate in unison and axially move on the machine tool spindle 10, due to the torque transmission of the screws 18 and keys 37,39.

Because of the inherent clearances necessary to slidably move the adjustable tool mount 14, it is necessary in a precision cutting tool assembly to remove the radial clearances, or "shake", from the assembly. To accomplish the purpose, and to provide a clamping means for positively securing the adjustable tool mount 14 in position, a like plurality of nested conical spring rings 43 are received in each of the counterbores 22,32, of the back flange ring 16 and outer compression ring 30.

While the rings 43 have been depicted with an exaggerated thickness, a variety of thicknesses may be employed, together with a variety of numbers of springs 43. The springs 43 each have a precision machined bore 44 and have a precision machined outer diameter 45, as well. By confining the spring rings 43 within a given counterbore 22,32 and slidably locating them on the machine tool spindle 10, it may be appreciated that as an axial load is applied to the spring stack, the spring rings 43 will tend to become enlarged at their outer diameter 45 and will tend to be reduced at their bore 44. Thus, when an axial load is applied by the oppositely disposed counterbore seats 23,33 shouldered against the spring rings 43, the adjustable tool mount 14 will be securely clamped in frictional engagement with the tool spindle 10.

While the conical spring rings 43 may be manufactured from a variety of materials, such rings are commercially available under several trademarks. The Ringfeder® conical ring is a commercially available solid ring designed for clamping gears, sprockets, and the like in a fixed position on a shaft. The Ringspann® locking ring is another commercially available spring ring which is relieved at certain portions around its circumference so that it will have greater flex than a solid ring.

In order to effect clamping and unclamping of the tool mount 14, a lock nut 46 is threadably received on the threaded end 26 of the front flange ring 17. The lock nut 46 has internal threads 47 terminating at an inner surface 48 which abuts the outer compression ring 30. A clearance hole 49 is machined through the center of the adjusting nut 46, and a plurality of radially-extending holes 50 are machined in the circumference of the lock nut 46 so that a spanner wrench may be utilized in rotating the nut 46. While the lock nut 46 may stay in its adjusted position due to frictional forces, a more secure assembly is attained by inserting a lock screw 51 through one of a plurality of closely spaced clearance holes 52 provided through the lock nut 46, any one of which may be aligned with a threaded hole 53 in the front flange ring 17.

The invention has been shown in conjunction with a machine utilizing a plurality of grinding wheels, but it may be appreciated that other tools, such as rotary milling cutters may be employed.

It may also be preferred, in some instances, to provide seals within the cylindrical elements to create a watertight assembly.

Further, it may be appreciated that only one cutting tool may be employed, where the reference point might be a machine table, fixture etc.

While the invention has been shown in connection with a preferred embodiment, it is not intended that the invention be limited to such embodiment, but rather the invention extends to all such designs and modifications as come within the scope of the appended claims.

What is claimed is:

1. An adjustable tool mount for positioning a rotatable tool on a machine spindle, comprising:

(a) a tool holder, having a bore cooperatingly formed to a sliding fit with said machine spindle;

(b) an internal groove in said bore, said groove having an axial lead;

(c) a pin fixed in said spindle and extending radially therefrom into said groove;

(d) means for releasably clamping said tool holder in a fixed position relative to said spindle; and (e) means for rotating said tool holder relative to said spindle, thereby adjusting said tool holder on said spindle from a first axial position to a second axial position.

2. The tool mount of claim 1, wherein said means for releasably clamping said tool holder comprises:

(a) an end bore in said tool holder;

(b) a plurality of nested conical spring rings disposed around said spindle within said end bore, said rings having a central bore closely fitted to said spindle and having an outer diameter closely fitted to said end bore; and (c) shoulder means for adjustably compressing said spring rings in an axial direction against one another, thereby tending to enlarge said ring outer diameter and tending to reduce said ring bore.

3. An adjustable tool mount for positioning a rotatable tool on a machine spindle, comprising:

(a) a back flange ring, having a flange portion, a tool-receiving pilot diameter adjacent said flange portion, and a central counterbore in said pilot diameter;

(b) a front flange ring, having a flange portion, a tool-receiving pilot diameter adjacent said flange portion and disposed toward said back flange ring pilot diameter, a central bore, a counterbore in said flange portion, and a threaded end on said flange portion;

(c) means for securing said back and front flange rings to one another in rigid assembly with a specified tool;

(d) an outer compression ring, axially slidable in said front flange ring counterbore, and having a central counterbore opening toward said back flange ring;

(e) an inner compression ring, slidably received in said central counterbores of said back flange ring and said outer compression ring, and having a central bore slidably received with said spindle;

(f) first and second pluralities of nested conical spring rings received in said central counterbores and reacting against opposite ends of said outer compression ring, respectively;

(g) an internal groove in said central bore of said inner compression ring, said groove having an axial lead;

(h) a pin fixed in said spindle and extending radially therefrom into said groove, the pin profile corresponding to the groove cross-section;

(i) means for rotating said back and front flange rings and said inner and outer compression rings in unison relative to said spindle, thereby moving said rings on said spindle from a first axial position to a second axial position; and (j) an adjusting nut threadably received on said threaded end of said front flange ring, and compressibly loaded against said outer compression ring to effect clamping of said pluralities of nested conical springs.

4. The tool mount of claim 3 further comprising means for locking said adjusting nut in a predetermined orientation relative to said front flange ring.

* * * * *